US012728331B2

(12) United States Patent
Furuhi et al.

(10) Patent No.: US 12,728,331 B2
(45) Date of Patent: Sep. 8, 2026

(54) HIT POSITION ESTIMATION DEVICE AND HIT POSITION ESTIMATION METHOD

(71) Applicant: Murata Manufacturing Co., Ltd., Kyoto (JP)

(72) Inventors: Tomoshige Furuhi, Kyoto (JP); Nobuyuki Nozawa, Kyoto (JP); Koji Kawano, Kyoto (JP); Takehiko Iizuka, Kyoto (JP); Jun Makino, Kyoto (JP); Takashi Watanabe, Kyoto (JP); Kenta Ago, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 388 days.

(21) Appl. No.: 18/446,770

(22) Filed: Aug. 9, 2023

(65) Prior Publication Data

US 2023/0381615 A1 Nov. 30, 2023

Related U.S. Application Data

(63) Continuation of application No. PCT/JP2021/042868, filed on Nov. 24, 2021.

(30) Foreign Application Priority Data

Feb. 10, 2021 (JP) ..... 2021-019522

(51) Int. Cl.

| | |
|---|---|
| ***A63B 60/46*** | (2015.01) |
| ***A63B 69/36*** | (2006.01) |
| *A63B 102/32* | (2015.01) |

(52) U.S. Cl.
CPC ..... *A63B 60/46* (2015.10); *A63B 69/362* (2020.08); *A63B 2102/32* (2015.10);
(Continued)

(58) Field of Classification Search
CPC ... A63B 60/46; A63B 69/362; A63B 2102/32; A63B 2220/16; A63B 2220/62;
(Continued)

(56) References Cited

U.S. PATENT DOCUMENTS 3,792,863 A * 2/1974 Evans ..... A63B 69/3632 340/870.18
3,806,131 A * 4/1974 Evans ..... A63B 69/3632 340/870.18

(Continued)

FOREIGN PATENT DOCUMENTS

JP 2012-130414 A 7/2012
JP 2015-126813 A 7/2015

(Continued)

OTHER PUBLICATIONS

International Search Report for PCT/JP2021/042868 dated Feb. 15, 2022.

*Primary Examiner* — Nini F Legesse
(74) *Attorney, Agent, or Firm* — McDonald Hopkins LLC

(57) ABSTRACT

A hit position estimation device includes a sensor and a calculation unit. The sensor is attached to a shaft of a golf club and outputs a sensor signal including twisting of the shaft. The calculation unit estimates a position at which a ball hits a head from a twist component when the ball hits the head of the golf club, by using the sensor signal.

16 Claims, 5 Drawing Sheets

(52) U.S. Cl.
CPC ..... *A63B 2220/16* (2013.01); *A63B 2220/62* (2013.01); *A63B 2220/833* (2013.01)

(58) Field of Classification Search
CPC ..... A63B 2220/833; A63B 24/0006; A63B 24/0062; A63B 69/3632; A63B 2024/0068; A63B 2071/0625; A63B 71/0622; A63B 2220/13; A63B 2220/803; A63B 2225/50; A63B 2225/74; A63B 53/10
USPC ..... 473/219–225, 407, 409
See application file for complete search history.

(56) References Cited

U.S. PATENT DOCUMENTS

| | | | | |
|---|---|---|---|---|
| 5,779,555 | A * | 7/1998 | Nomura | A63B 69/3632 473/223 |
| 5,951,410 | A * | 9/1999 | Butler | A63B 60/42 473/223 |
| 6,213,888 | B1 * | 4/2001 | Kawaguchi | A63B 60/42 473/409 |
| 8,398,502 | B2 * | 3/2013 | Iwahashi | A63B 60/42 473/409 |
| 9,990,858 | B2 * | 6/2018 | Senno | G06V 40/23 |
| 2009/0131196 | A1 | 5/2009 | Werner et al. | |
| 2010/0210371 | A1 * | 8/2010 | Sato | A63B 60/42 473/223 |
| 2012/0157241 | A1 | 6/2012 | Nomura et al. | |
| 2015/0185013 | A1 | 7/2015 | Abe | |
| 2017/0340936 | A1 | 11/2017 | Hanamitsu et al. | |
| 2021/0213327 | A1 | 7/2021 | Ohta et al. | |

FOREIGN PATENT DOCUMENTS

| | | | |
|---|---|---|---|
| JP | 2017-213145 | A | 12/2017 |
| JP | 2018-175496 | A | 11/2018 |

* cited by examiner

HIT POSITION ESTIMATION DEVICE AND HIT POSITION ESTIMATION METHOD

CROSS REFERENCE TO RELATED APPLICATION

This is a continuation of International Application No. PCT/JP2021/042868 filed on Nov. 24, 2021 which claims priority from Japanese Patent Application No. 2021-019522 filed on Feb. 10, 2021. The contents of these applications are incorporated herein by reference in their entireties.

BACKGROUND ART

Technical Field

The present disclosure relates to a technique for detecting a position at which ball hits a club head.

Patent Document 1 describes a swing analysis device. The swing analysis device includes a sensor, a posture calculation unit and a correction unit.

The sensor is attached to a shaft of a golf club and outputs acceleration information, angular velocity information and distortion information of the shaft. The posture calculation unit calculates posture of the golf club in a period of a swing, based on the acceleration information and the angular velocity information. The correction unit corrects posture information at impact, based on the distortion information.

Patent Document 1: Japanese Unexamined Patent Application Publication No. 2018-175496

BRIEF SUMMARY

However, in the configuration described in Patent Document 1, it was not possible to estimate a position at which a ball hits a club head of the golf club.

The present disclosure to provide a technique for estimating a position at which a ball hits a club head.

A hit position estimation device of the present disclosure includes a sensor and a calculation unit. The sensor is attached to sports equipment including a columnar portion and a hitting portion connected to the columnar portion and is attached not at the hitting portion but at the columnar portion and outputs a sensor signal including twisting of the columnar portion. The calculation unit estimates, by using the sensor signal, from a component of the twisting when the hitting portion externally receives pressure, a position at which the hitting portion externally receives the pressure.

In this configuration, a fact that a way of twisting of the columnar portion differs according to the position at which the hitting portion externally receives pressure from a desired object (a hit position) is utilized to estimate, based on output of the sensor attached to the columnar portion, the position at which the hitting portion externally receives the pressure (a hit position).

According to the present disclosure, it is possible to estimate a position at which a desired object hits a hitting portion, for example, when sports equipment is a golf club, a position at which a ball hits a head.

DETAILED DESCRIPTION

First Embodiment

Figure 1:
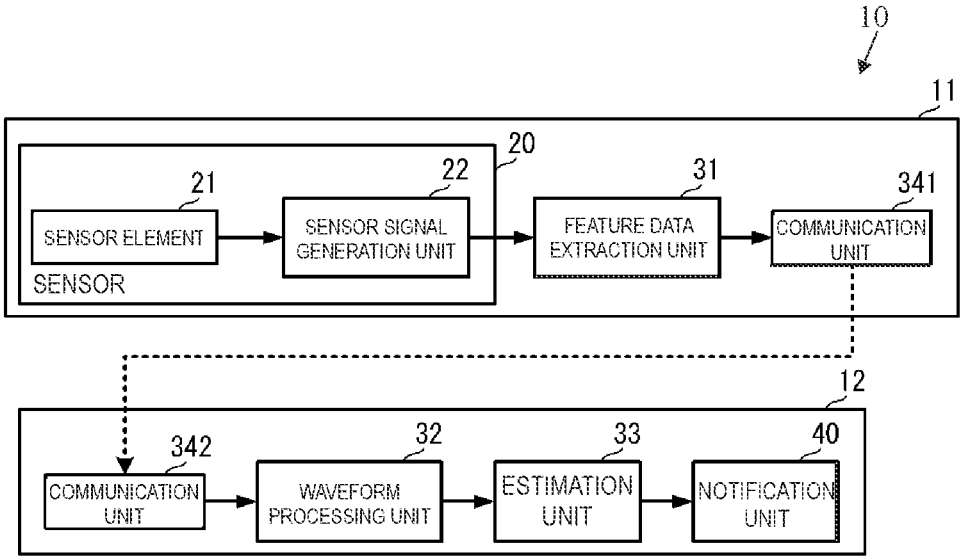
FIG. 1 is a functional block diagram of a hit position estimation device according to a first embodiment.
Figure 2:
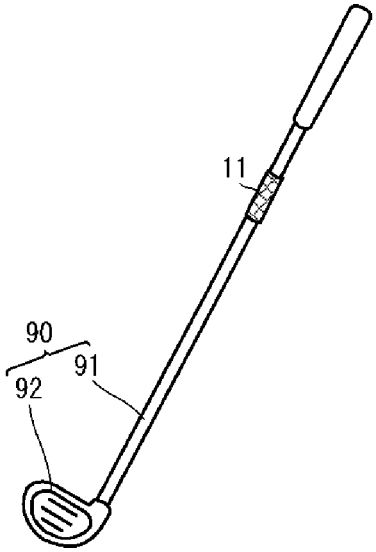
FIG. 2 is a diagram illustrating an example of a state in which a first electronic device of the hit position estimation device is attached to a golf club.

A hit position estimation technique according to a first embodiment of the present disclosure will be described with reference to the drawings. FIG. 1 is a functional block diagram of the hit position estimation device according to the first embodiment. FIG. 2 is a diagram illustrating an example of a state in which a first electronic device of the hit position estimation device is attached to a golf club.

As illustrated in FIG. 1, a hit position estimation device 10 includes a first electronic device 11 and a second electronic device 12. The first electronic device 11 and the second electronic device 12 are separate bodies.

The first electronic device 11 includes a sensor 20, a feature data extraction unit 31 and a communication unit 341. The sensor 20 includes a sensor element 21 and a sensor signal generation unit 22. The sensor signal generation unit 22, the feature data extraction unit 31 and the communication unit 341 are achieved by, for example, a plurality of electronic circuit elements such as processors or ICs mounted on a circuit board or the like.

The sensor element 21 includes a film-like main body having piezoelectric properties and a detection electrode. The main body contains, for example, polylactic acid as a main component and is polarized according to bending and twisting. At this time, a polarization direction changes according to a direction of the bending and a direction of the twisting, and magnitude of charge generated by the polarization differs according to magnitude of the bending and magnitude of the twisting.

The detection electrode is attached to a surface of the main body. At this time, the detection electrode is attached to the main body such that charge due to bending and charge due to twisting can be outputted.

The sensor signal generation unit 22 is achieved by a predetermined electronic circuit. The sensor signal generation unit 22 includes, for example, an integration circuit, and generates a sensor signal which is a voltage signal from charge generated in the sensor element 21.

Here, as illustrated in FIG. 2, a golf club 90 includes a shaft 91 and a head 92. The shaft 91 is a linear rod body. The head 92 is installed at one end in a direction in which the shaft 91 extends. An end portion of the shaft 91 on a side opposite to an attachment position of the head 92 is a grip.

The golf club 90 corresponds to "sports equipment" of the present disclosure, the shaft 91 corresponds to a "columnar portion" of the present disclosure, and the head 92 corresponds to a "hitting portion" of the present disclosure. Then, a golf ball hit by the golf club 90 corresponds to a "desired object" of the present disclosure.

The first electronic device 11 is attached to the shaft 91. In the example of FIG. 2, the first electronic device 11 is attached to a vicinity of the grip of the shaft 91, but the attachment position of the first electronic device 11 to the shaft 91 is not limited thereto.

Accordingly, the sensor 20 outputs a sensor signal according to bending and twisting of the shaft 91. That is, the sensor signal includes a bend component Sxb in an xb direction, a bend component Syb in a yb direction and a twist component Sθtw. Then, the bend component Sxb in the xb direction, the bend component Syb in the yb direction and the twist component Sθtw are individually detected.

Figure 3:
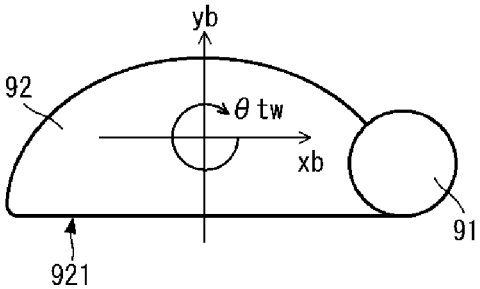
FIG. 3 is a schematic top view of a head of the golf club for defining bending and twisting.

Here, bending of the shaft 91 in the xb direction, bending of the shaft 91 in the yb direction and twisting of the shaft 91 are defined as follows, for example. FIG. 3 is a schematic top view of the head of the golf club for defining the bending and the twisting.

As illustrated in FIG. 3, the xb direction is a direction parallel to a face 921 of the head 92. The shaft 91 is attached to one end of the head 92 in the xb direction. A side of the head 92 to which the shaft 91 is attached is referred to as a heel side, and a side opposite to the side to which the shaft 91 is attached is referred to as a toe side.

In the xb direction, with a center of the head 92 as the origin, the heel side is a positive region and the toe side is a negative value. That is, the bend component Sxb in the xb direction becomes a positive value having a larger absolute value as bending toward the heel side increases, and becomes a negative value having a larger absolute value as bending toward the toe side increases.

As illustrated in FIG. 3, the yb direction is a direction perpendicular to the face 921 of the head 92. In the yb direction, with a center of the head 92 as the origin, a side of the face 921 is a negative region, and a side opposite to the face 921 side is a positive region. That is, the bend component Syb in the yb direction becomes a positive value having a larger absolute value as bending toward the side opposite to the face 921 side increases, and becomes a negative value having a larger absolute value as bending toward the face 921 side increases.

As illustrated in FIG. 3, a twist θtw indicates a direction of rotation about an axis perpendicular to the xb direction and the yb direction. The twist component Sθtw becomes a positive value when the heel of the head 92 is located at a forward side of the toe (in a negative direction of the yb direction), and becomes a negative value when the heel of the head 92 is located at a rearward side of the toe (in a positive direction of the yb direction). Then, as an amount of twisting thereof increases, an absolute value of the twist component Sθtw increases.

Then, the sensor signal generation unit 22 of the sensor 20 outputs a sensor signal including the bend component Sxb in the xb direction, the bend component Syb in the yb direction and the twist component Sθtw, which change as described above, to the feature data extraction unit 31.

Note that the definitions of the bend component Sxb in the xb direction, the bend component Syb in the yb direction and the twist component Sθtw are not limited to those described above, and other definitions may be used as long as bending of the shaft 91 in a direction parallel to the face 921, bending of the shaft 91 in a direction perpendicular to the face 921 and twisting of the shaft 91 can be uniquely defined.

Figure 4:
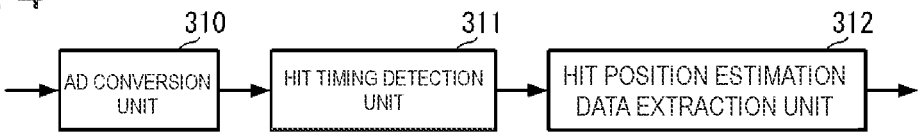
FIG. 4 is a functional block diagram of a feature data extraction unit according to the first embodiment.

The feature data extraction unit 31 extracts data for hit position estimation using the sensor signal. FIG. 4 is a functional block diagram of the feature data extraction unit according to the first embodiment.

As illustrated in FIG. 4, the feature data extraction unit 31 includes an AD conversion unit 310, a hit timing detection unit 311 and a hit position estimation data extraction unit 312.

The AD conversion unit 310 performs AD conversion (analog-to-digital conversion) on the sensor signal. The AD conversion unit 310 outputs the digitized sensor signal to the hit timing detection unit 311.

The hit timing detection unit 311 detects, for example, a time when an absolute value of the sensor signal changes greatly, and detects this detected timing as hit timing. The hit timing detection unit 311 outputs the sensor signal and the hit timing to the hit position estimation data extraction unit 312.

The hit position estimation data extraction unit 312 extracts sensor signals in a period of a predetermined time length starting from the hit timing, and outputs the sensor signals as data for hit position estimation.

The communication unit 341 transmits the data for hit position estimation to a communication unit 342 of the second electronic device 12.

The second electronic device 12 is achieved by, for example, an information processing portable terminal such as a smart phone or an information processing device such as a personal computer, which is not installed at the golf club 90.

The second electronic device 12 includes the communication unit 342, a waveform processing unit 32, an estimation unit 33 and a notification unit 40.

The communication unit 342 receives the data for hit position estimation from the communication unit 341 of the first electronic device 11. The communication unit 342 outputs the data for hit position estimation to the waveform processing unit 32.

The waveform processing unit 32 performs complex Fourier transform processing on the data for hit position estimation. Thus, the waveform processing unit 32 generates a complex frequency spectrum (complex frequency component) of hit position estimation data. The waveform processing unit 32 outputs the complex frequency spectrum of the hit position estimation data to the estimation unit 33.

Schematically, the estimation unit 33 estimates a hit position using at least the twist component Sθtw, and outputs the estimated hit position to the notification unit 40. Note that specific configuration and estimation concept of the estimation unit 33 will be described later.

The notification unit 40 is achieved by a display, a speaker, a lamp, or the like. The notification unit 40 performs notification according to the hit position. For example, when the notification unit 40 is a display, the notification unit 40 displays an image of the face 921 of the head 92, and a mark of the estimated hit position superimposed on the image. In addition, when the notification unit 40 is a speaker, the notification unit 40 changes a type of sound according to the hit position and emits the sound. In addition, when the notification unit 40 is a lamp, the notification unit 40 performs lighting, blinking or light emission of a color according to the hit position.

(First Aspect of Estimation of Hit Position)

Figure 5:
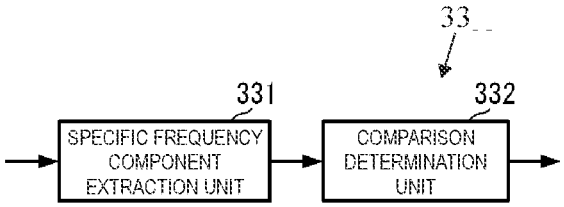
FIG. 5 is a functional block diagram illustrating an example of a first aspect of an estimation unit.

The estimation unit 33 estimates a hit position using a complex frequency spectrum of hit position estimation data. FIG. 5 is a functional block diagram illustrating an example of a first aspect of the estimation unit.

As illustrated in FIG. 5, the estimation unit 33 includes a specific frequency component extraction unit 331 and a comparison determination unit 332. Note that a more specific concept of estimation of a hit position performed by the estimation unit 33 will be described later.

The specific frequency component extraction unit 331 extracts a specific frequency component in a complex frequency spectrum of hit position estimation data. To be more specific, the specific frequency component extraction unit 331 extracts a value Retwf1 of a real part of a specific frequency component (a frequency f1 (for example, about 32.0 Hz)) in a complex frequency spectrum of the twist component Sθtw from hit position estimation data. Note that the specific frequency is set based on a shape and a material of the golf club 90, more specifically, a shape and a material of the head 92 and a shape and a material of the shaft 91, and is set based on a frequency at which a peak of a predetermined level occurs when a ball hits a portion other than a center of the face 921.

The specific frequency component extraction unit 331 outputs the value Retwf1 of the real part of the specific frequency component of the twist component Sθtw to the comparison determination unit 332. The specific frequency component extraction unit 331 corresponds to a "spectral intensity calculation unit" of the present disclosure.

The comparison determination unit 332 stores a threshold value for hit position estimation in advance. The comparison determination unit 332 compares the value Retwf1 of the real part of the specific frequency component of the twist component Sθtw with the threshold value for hit position estimation to estimate the hit position.

Figure 6:
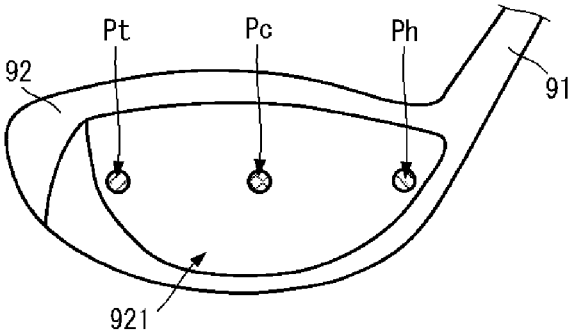
FIG. 6 is a front view of the head illustrating an example of an estimated hit position.
Figure 7A:
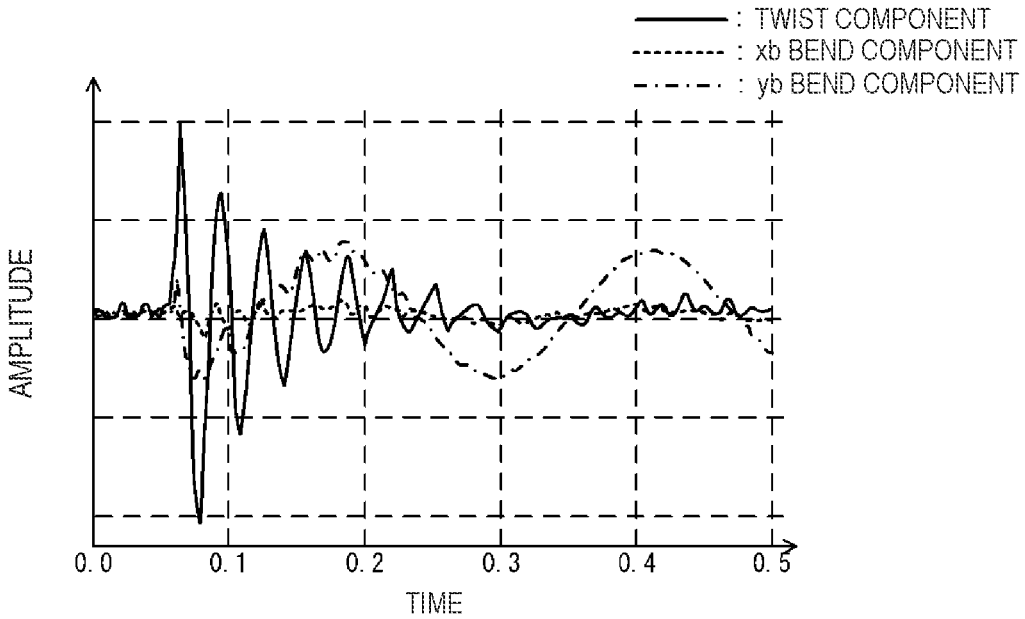
FIG. 7A is a graph showing an example of waveforms of sensor signal when a toe side of the head is hit (a position Pt in FIG. 6)
Figure 7B:
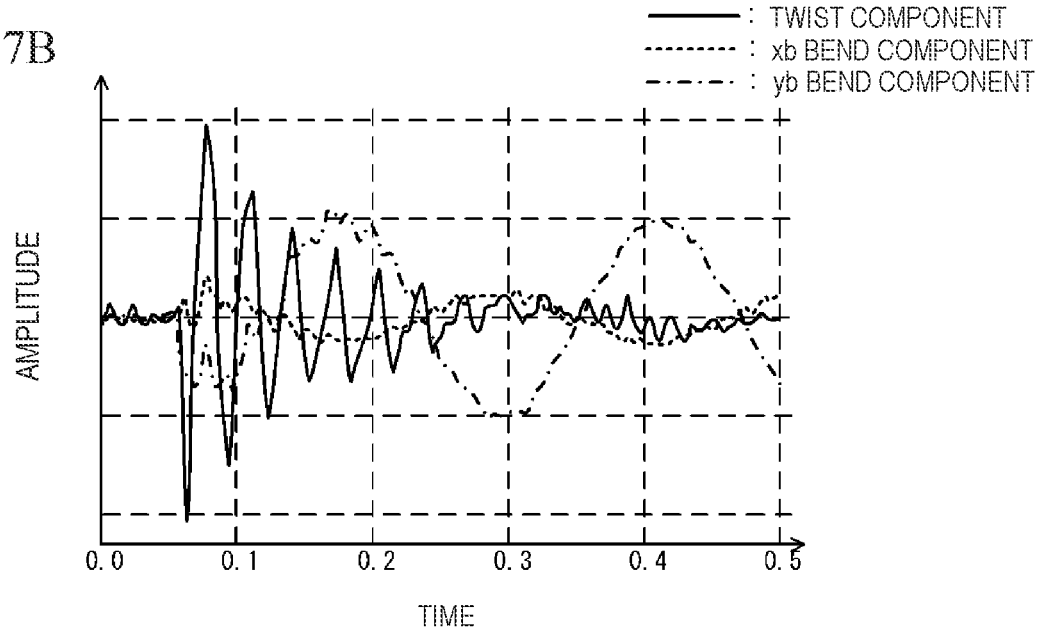
FIG. 7B is an example of a waveform diagram of sensor signal when a heel side of the head is hit (a position Ph in FIG. 6).
Figure 8:
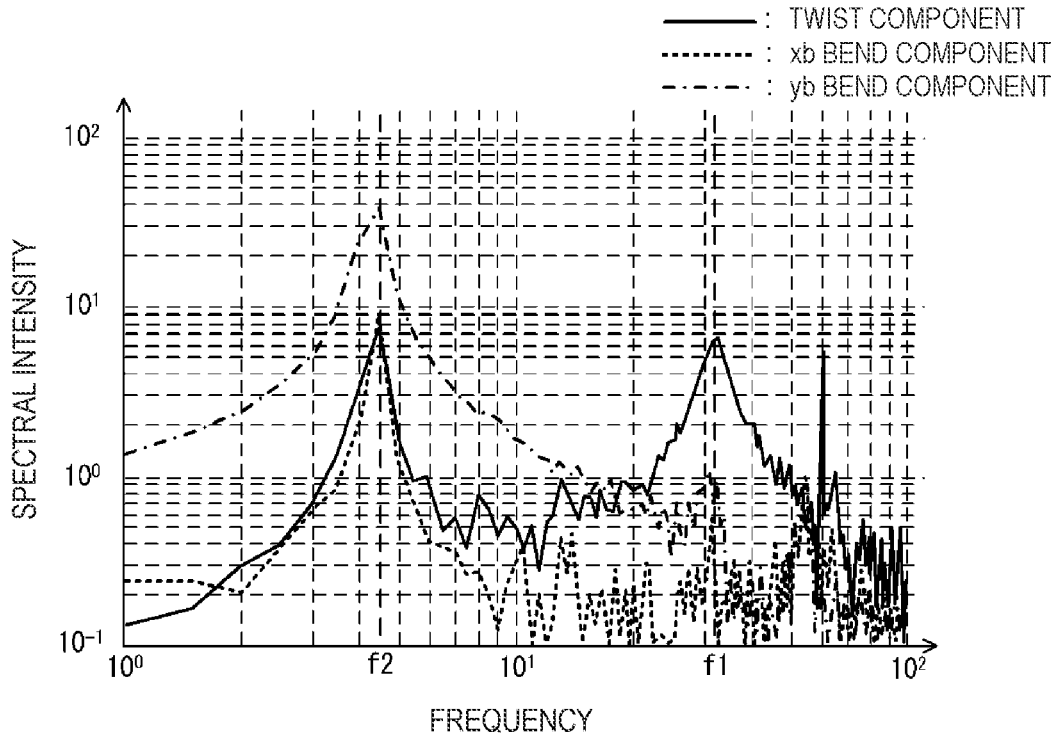
FIG. 8 is a graph showing frequency spectrum in the case of FIG. 7A.
Figure 9:
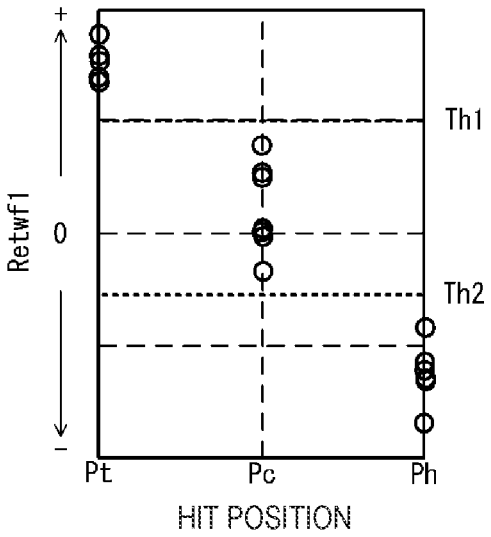
FIG. 9 is a graph showing a relationship between value of a mounting portion and threshold value.

FIG. 6 is a front view of the head illustrating an example of an estimated hit position. FIG. 7A is a graph showing an example of waveforms of sensor signal when the toe side of the head is hit (the position Pt in FIG. 6), and FIG. 7B is an example of a waveform diagram of a sensor signal when the heel side of the head is hit (the position Ph in FIG. 6). In FIG. 7A, a solid line indicates the twist component Sθtw, a broken line indicates the bend component Sxb in the xb direction and an alternate long and short dash line indicates the bend component Syb in the yb direction. FIG. 8 is a graph showing frequency spectrum in the case of FIG. 7A. FIG. 9 is a graph showing a relationship between value of a mounting portion and the threshold value.

When the ball hits the position Pt on the toe side illustrated in FIG. 6, a sensor signal having the waveform as illustrated in FIG. 7A is obtained. When the ball hits the position Ph on the heel side illustrated in FIG. 6, a sensor signal having the waveform as illustrated in FIG. 7B is obtained.

As shown in FIG. 7A and FIG. 7B, behavior of the twist component Sθtw is greatly different between the case where the ball hits the position Pt on the toe side and the case where the ball hits the position Ph on the heel side. More specifically, when the ball hits the position Pt on the toe side, the twist component Sθtw greatly varies to be a positive value immediately after timing of the hit, changes to be a negative value, and then gradually attenuates while oscillating at a predetermined cycle. On the other hand, when the ball hits the position Ph on the heel side, the twist component Sθtw greatly varies to be a negative value immediately after timing of the hit, changes to be a positive value, and then gradually attenuates while oscillating at a predetermined cycle.

This is because the head 92 is displaced and the shaft 91 is twisted when a position at which the ball hits is shifted from a center position Pc (see FIG. 6) of the face 921 at the timing of the hit. More specifically, the reason is that when the ball hits the position Pt on the toe side, the toe side is located at a rearward side of the heel side, and twisting having a positive value corresponding to this occurs in the shaft 91. On the other hand, the reason is that when the ball hits the position Ph on the heel side, the toe side is located forward the heel side, and twisting having a negative value corresponding to this occurs in the shaft 91.

Note that although not illustrated, when the ball hits the center position Pc of the face 921, twisting of the shaft 91 is extremely small and amplitude of the twist component Sθtw is small.

Using this feature, the estimation unit 33 estimates the hit position using a value of a real part of a complex frequency spectrum. More specifically, as described above, the twist component Sθtw attenuates while oscillating at a specific frequency. Thus, by obtaining the complex frequency spectrum, a component of the specific frequency of the twist component Sθtw can be extracted. For example, as shown in FIG. 8, spectral intensity at a specific frequency f1 (for example, 32 Hz) is obtained, and changes in the twist component Sθtw due to a hit can be detected more reliably.

The specific frequency component extraction unit 331 extracts the spectral intensity of the specific frequency f1 (for example, 32 Hz).

As illustrated in FIG. 9, the value Retwf1 of the real part of the spectral intensity of the specific frequency f1 changes according to the hit position. To be more specific, when the position Pt on the toe side is hit, the value Retwf1 of the real part becomes a positive value greater than a first threshold value Th1. On the other hand, when the position Ph on the heel side is hit, the value Retwf1 of the real part becomes a negative value less than a second threshold value Th2. In addition, when the center position Pc is hit, the value Retwf1 of the real part becomes a value between the first threshold value Th1 and the second threshold value Th2. The first threshold value Th1 and the second threshold value Th2 each corresponds to a "determination threshold value" of the present disclosure.

Using this feature, the comparison determination unit 332 compares the value Retwf1 of the real part with the first threshold value Th1 and the second threshold value Th2. Then, when the value Retwf1 of the real part is equal to or greater than the first threshold value Th1, the comparison determination unit 332 determines that the position Pt on the toe side is hit. When the value Retwf1 of the real part is equal to or less than the second threshold value Th2, the comparison determination unit 332 determines that the position Ph on the heel side is hit. When the value Retwf1 of the real part is greater than the second threshold value Th2 and less than the first threshold value Th1, the comparison determination unit 332 determines that the center position Pc is hit.

As described above, by using the configuration and the processing of the present embodiment, the hit position estimation device 10 can estimate the position at which the ball hits the head 92 when the sensor element 21 is attached to the shaft 91 and the sensor element 21 not being attached to the head 92.

At this time, the hit position estimation device 10 calculates the complex frequency spectrum and extracts and uses the spectral intensity of the specific frequency, thereby more reliably detecting the change in the twist component due to the hit. Accordingly, the hit position estimation device 10 can estimate the hit position more reliably.

Note that the aspect has been illustrated in which the complex frequency spectrum is used in the hit position estimation device 10, but an actually measured value of the twist component Sθtw may be used as is. In this case, the hit position estimation device 10 estimates the hit position by comparing the actually measured value of the twist component Sθtw with a threshold value. Note that a concept of setting the threshold value is similar to that in the case of using the complex frequency spectrum described above, and a description thereof will be omitted. Then, in this case, the waveform processing unit 32 can be omitted in the hit position estimation device 10.

In addition, in the above description, the aspect has been illustrated in which the bend component Sxb in the xb direction and the bend component Syb in the yb direction are detected together with the twist component Sθtw. However, when the configuration of the estimation unit 33 is used, the detection of the bend component Sxb in the xb direction and the bend component Syb in the yb direction can be omitted. That is, when the configuration of the estimation unit 33 is used, as described above, it is sufficient that at least the twist component Sθtw can be detected.

(Second Aspect of Estimation of Hit Position)

Figure 10:
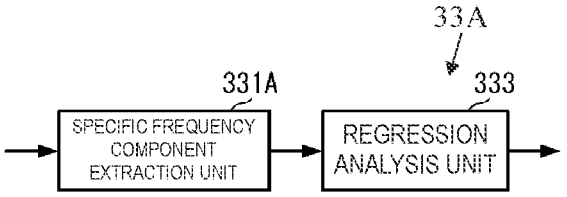
FIG. 10 is a functional block diagram illustrating an example of a second aspect of the estimation unit.

FIG. 10 is a functional block diagram illustrating an example of a second aspect of the estimation unit. As illustrated in FIG. 10, an estimation unit 33A includes a specific frequency component extraction unit 331A and a regression analysis unit 333.

The specific frequency component extraction unit 331A extracts a specific frequency component in a complex frequency spectrum of hit position estimation data. To be more specific, the specific frequency component extraction unit 331 extracts complex amplitudes of a plurality of specific frequency components (the frequency f1 (see FIG. 8, for example, about 32.0 Hz) and the frequency f2 (see FIG. 8, for example about 4.5 Hz) in the complex frequency spectra of the bend component Sxb in the xb direction, the bend component Syb in the yb direction and the twist component Sθtw, that is, Axbf1*r*, Axbf1*i*, Aybf1*r*, Aybf1*i*, Aθf1*r*, Aθf1*i*, Axbf2*r*, Axbf2*i*, Aybf2*r*, Aybf2*i*, Aθf2*r* and Aθf2*i*, from the hit position estimation data.

The complex amplitudes Axbf1*r* and Axbf1*i* are a real part and an imaginary part of the bend component Sxb in the xb direction of the frequency f1, the complex amplitudes Aybf1*r* and Aybf1*i* are a real part and an imaginary part of the bend component Syb in the yb direction of the frequency f1, and the complex amplitudes Aθf1*r* and Aθf1*i* are a real part and an imaginary part of the twist component Sθtw of the frequency f1. The complex amplitudes Axbf2*r* and Axbf2*i* are a real part and an imaginary part of the bend component Sxb in the xb direction of the frequency f2, the complex amplitudes Aybf2*r* and Aybf2*i* are a real part and an imaginary part of the bend component Syb in the yb direction of the frequency f2, and the complex amplitudes Aθf2*r* and Aθf2*i* are a real part and an imaginary part of the twist component Sθtw of the frequency f2.

The specific frequency component extraction unit 331A outputs the complex amplitudes Axbf1*r*, Axbf1*i*, Aybf1*r*, Aybf1*i*, Aθf1*r*, Aθf1*i*, Axbf2*r*, Axbf2*i*, Aybf2*r*, Aybf2*i*, Aθf2*r* and Aθf2*i* to the regression analysis unit 333.

The regression analysis unit 333 stores a regression equation having a regression coefficient and an intercept calculated in advance by an experiment. The regression coefficient and the intercept of the regression equation are set as follows, for example.

Figure 11:
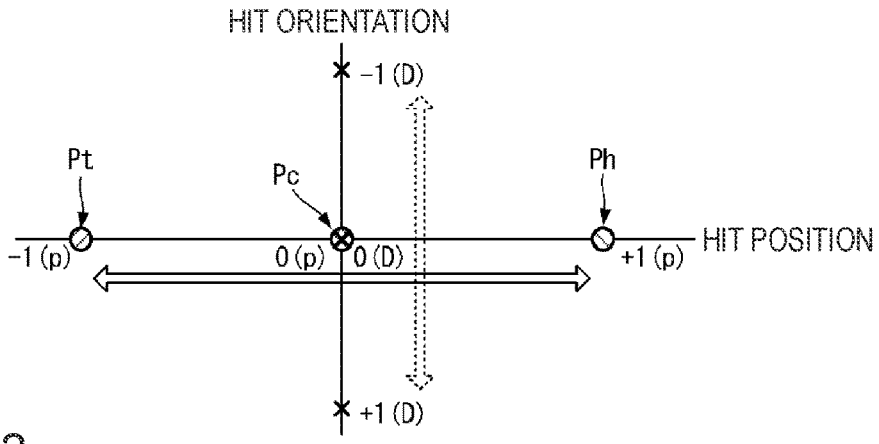
FIG. 11 is a coordinate diagram for explaining a setting concept of a regression equation.

FIG. 11 is a coordinate diagram for explaining a setting concept of the regression equation. As illustrated in FIG. 11, a two-dimensional objective variable including a hit position p and a hit orientation D is set for the face 921. For the hit position p, 0(p) is set to the center position Pc of the face 921, +1(p) is set to the position Ph on the heel side, and −1(p) is set to the position Pt on the toe side. For the hit orientation D, 0(D) is set to a direction perpendicular to the face 921, +1(D) is set to an orientation from the heel side, and −1(D) is set to an orientation from the toe side.

With respect to such an objective variable, a ball is caused to hit the face 921 a predetermined number of times experimentally. At this time, a hit position and a hit orientation of the ball are set according to the above-mentioned objective variable. Then, experimental complex amplitudes Axbf1*rt*, Axbf1*it*, Aybf1*rt*, Aybf1*it*, Aθf1*rt*, Aθf1*it*, Axbf2*rt*, Axbf2*it*, Aybf2*rt*, Aybf2*it*, Aθf2*rt* and Aθf2*it* are obtained.

Next, the experimental complex amplitudes Axbf1*rt*, Axbf1*it*, Aybf1*rt*, Aybf1*it*, Aθf1*rt*, Aθf1*it*, Axbf2*rt*, Axbf2*it*, Aybf2*rt*, Aybf2*it*, Aθf2*rt* and Aθf2*it* and the objective variable are substituted in a regression equation for which a regression coefficient and an intercept are unknown, and the regression coefficient and the intercept are set so as to minimize errors thereof. Accordingly, the regression coefficient and intercept that are optimized are set.

The regression analysis unit 333 substitutes the complex amplitudes Axbf1*r*, Axbf1*i*, Aybf1*r*, Aybf1*i*, Aθf1*r*, Aθf1*i*, Axbf2*r*, Axbf2*i*, Aybf2*r*, Aybf2*i*, Aθf2*r* and Aθf2*i* from the specific frequency component extraction unit 331A in the regression equation for which the optimized regression coefficient and the intercept are set. Thus, the regression analysis unit 333 estimates the hit position of the ball.

By using such a method, the estimation unit 33A can estimate not only the hit position but also the hit orientation.

Note that, for example, in a case where the number of unknowns is decreased such as a case where the hit orientation is not estimated, it is also possible not to use at least one of the bend component Sxb in the xb direction and the bend component Syb in the yb direction in the regression analysis. Accordingly, for example, an estimation speed can be improved.

Figure 12:
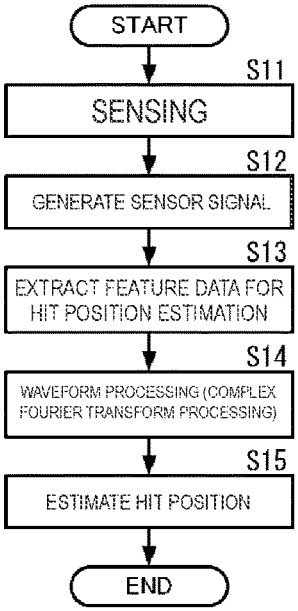
FIG. 12 is a flowchart illustrating a hit position estimation method according to the embodiment of the present disclosure.

FIG. 12 is a flowchart illustrating a hit position estimation method according to the embodiment of the present disclosure. Note that specific contents of each process of the flowchart illustrated in FIG. 12 are described in the description of the above-described configuration, and detailed descriptions thereof will be omitted.

The sensor 20 senses bending and twisting of the shaft 91 of the golf club 90 (S11). The sensor 20 generates a sensor signal from a result of the sensing (S12).

The feature data extraction unit 31 extracts feature data for hit position estimation in the sensor signal (S13).

The waveform processing unit 32 performs waveform processing on the feature data for hit position estimation (S14). More specifically, the waveform processing unit 32 performs complex Fourier transform processing on the feature data for hit position estimation.

The estimation unit 33 estimates a hit position using a result of the complex Fourier transformation processing (S15).

Second Embodiment

Figure 13A:
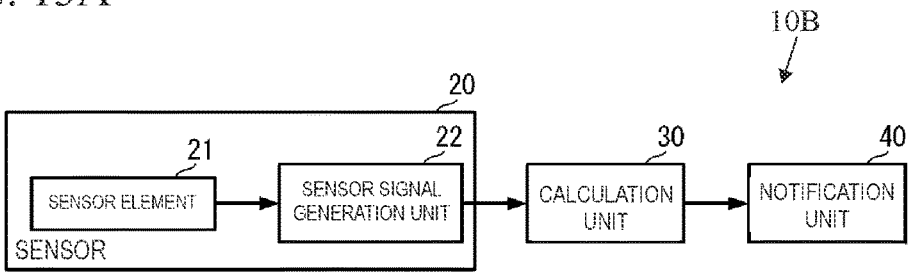
FIG. 13A is a functional block diagram of a hit position estimation device according to a second embodiment.

A hit position estimation technique according to a second embodiment of the present disclosure will be described with reference to the drawings. FIG. 13A is a functional block diagram of a hit position estimation device according to the second embodiment, and FIG. 13B is a functional block diagram illustrating a configuration of the calculation unit 30.

Figure 13B:
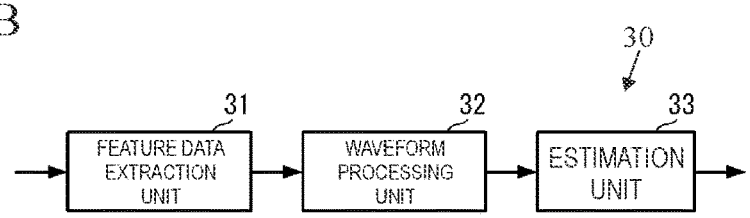
FIG. 13B is a functional block diagram illustrating a configuration of a calculation unit 30 (e.g., a processor).

As illustrated in FIG. 13A and FIG. 13B, a hit position estimation device 10B according to the second embodiment is different from the hit position estimation device 10 according to the first embodiment in that an entirety of the device is formed in one housing (electronic device). Other configurations of the hit position estimation device 10B are similar to those of the hit position estimation device 10, and description of similar portions will be omitted.

The hit position estimation device 10B is attached to the shaft 91 such that the sensor element 21 is disposed along a surface of the shaft 91 and the sensor element 21 deforms according to displacement of the shaft 91.

The sensor 20 includes the sensor element 21 and the sensor signal generation unit 22. The sensor 20 outputs a sensor signal to the calculation unit 30.

The calculation unit 30 includes the feature data extraction unit 31, the waveform processing unit 32 and the estimation unit 33. As described in the above first embodiment, the calculation unit 30 estimates a hit position using at least the twist component Sθtw included in the sensor signal. The calculation unit 30 outputs the hit position to the notification unit 40.

The notification unit 40 performs notification according to the hit position. Note that in this embodiment, since the hit position estimation device 10B is attached to the shaft 91, the notification unit 40 can be small and, for example, the notification unit 40 can be a small speaker or the like. Alternatively, the notification unit 40 may be a lamp or the like. Further, the notification unit 40 may be formed as a separate body, and, for example, a display unit of a smart phone may be used as the notification unit 40, and a hit position may be outputted to the smart phone.

Note that in the above description, the aspect in which the golf club is used as the sports equipment has been illustrated. However, the configuration of the present disclosure can be applied to any sports equipment (for example, a bat for baseball or the like, or a racket for tennis, badminton, or the like), and the same effects can be obtained, as long as the sports equipment has a columnar portion and displacement occurs in the columnar portion when hit by a desired object such as a ball, a shuttle, or the like.

REFERENCE SIGNS LIST

10, 10B HIT POSITION ESTIMATION DEVICE
11 FIRST ELECTRONIC DEVICE
12 SECOND ELECTRONIC DEVICE
20 SENSOR
21 SENSOR ELEMENT
22 SENSOR SIGNAL GENERATION UNIT
30 CALCULATION UNIT
31 FEATURE DATA EXTRACTION UNIT
32 WAVEFORM PROCESSING UNIT
33 ESTIMATION UNIT
33A ESTIMATION UNIT
40 NOTIFICATION UNIT
90 GOLF CLUB
91 SHAFT
92 HEAD
310 AD CONVERSION UNIT
311 HIT TIMING DETECTION UNIT
312 HIT POSITION ESTIMATION DATA EXTRACTION UNIT
331, 331A SPECIFIC FREQUENCY COMPONENT EXTRACTION UNIT
332 COMPARISON DETERMINATION UNIT
333 REGRESSION ANALYSIS UNIT
341, 342 COMMUNICATION UNIT
921 FACE

The invention claimed is:

1. A hit position estimation device for sports equipment including a columnar portion and a hitting portion connected to the columnar portion, comprising:

a sensor that is attached to the columnar portion and is not attached to the hitting portion, and that is configured to output a sensor signal including a twist component caused by twisting of the columnar portion; and a processor configured to estimate a position at which the hitting portion is externally pressured, by using the twist component of the sensor signal when the hitting portion is externally pressured.

2. The hit position estimation device according to claim 1, wherein the processor is configured to estimate the position at which the hitting portion is externally pressured by using a spectral intensity of a specific frequency of the twist component.

3. The hit position estimation device according to claim 2, wherein the processor is configured to:

store a determination threshold value for the spectral intensity of the specific frequency, and estimate the position at which the hitting portion is externally pressured by using a result of a comparison between the spectral intensity of the specific frequency and the determination threshold value.

4. The hit position estimation device according to claim 3, wherein the processor is configured to use a value of a real part of a complex amplitude of the specific frequency, as the spectral intensity of the specific frequency.

5. The hit position estimation device according to claim 2, wherein the processor is configured to:

detect a timing at which the hitting portion is externally pressured by using the sensor signal, extract data from the sensor signal, based on the timing, determine the spectral intensity of the specific frequency by using the data, and estimate the position at which the hitting unit is externally pressured by using the spectral intensity of the specific frequency.

6. The hit position estimation device according to claim 1, wherein the processor is configured to estimate the position at which the hitting portion is externally pressured by further using a bend component of the columnar portion included in the sensor signal.

7. The hit position estimation device according to claim 6, wherein the processor is configured to estimate the position at which the hitting portion is externally pressured by using a plurality of frequency components of each of the twist component and the bend component.

8. The hit position estimation device according to claim 7, wherein the processor is configured to estimate the position at which the hitting portion is externally pressured by using a regression analysis in which a complex frequency component is used.

9. A hit position estimation method for sports equipment including a columnar portion and a hitting portion connected to the columnar portion, comprising:

outputting, by a sensor that is attached to the columnar portion and is not attached to the hitting portion, a sensor signal including a twist component caused by twisting of the columnar portion; and estimating, by using the twist component of the sensor signal when the hitting portion is externally pressured, a position at which the hitting portion is externally pressured.

10. The hit position estimation method according to claim 9, wherein the position at which the hitting portion is externally pressured is estimated by using a spectral intensity of a specific frequency of the twist component.

11. The hit position estimation method according to claim 10, further comprising:

storing a determination threshold value for the spectral intensity of the specific frequency, wherein the position at which the hitting portion is externally pressured is estimated by using a result of a comparison between the spectral intensity of the specific frequency and the determination threshold value.

12. The hit position estimation method according to claim 11, wherein a value of a real part of a complex amplitude of the specific frequency is used as the spectral intensity of the specific frequency.

13. The hit position estimation method according to claim 10, further comprising:

detecting timing at which the hitting portion is externally pressured by using the sensor signal, extracting data from the sensor signal, based on the timing, and determining the spectral intensity of the specific frequency by using the data, wherein the position at which the hitting portion is externally pressured is estimated by using the spectral intensity of the specific frequency.

14. The hit position estimation method according to claim 9, wherein the position at which the hitting portion is externally pressured is estimated by further using a bend component of the columnar portion included in the sensor signal.

15. The hit position estimation method according to claim 14, wherein the position at which the hitting portion is externally pressured is estimated by using a plurality of frequency components of each of the twist component and the bend component.

16. The hit position estimation method according to claim 15, wherein the position at which the hitting portion is externally pressured is estimated by using a regression analysis in which a complex frequency component is used.

* * * * *